United States Patent [19]

Asp

[11] Patent Number: 4,580,824

[45] Date of Patent: Apr. 8, 1986

[54] DOOR LOCK JAMB PLATE AND ASSEMBLY

[76] Inventor: Ralph T. Asp, 4160 Walton Blvd., Drayton Plains, Mich. 48020

[21] Appl. No.: 572,384

[22] Filed: Jan. 20, 1984

Related U.S. Application Data

[63] Continuation-in-part of Ser. No. 264,274, May 18, 1981, abandoned.

[51] Int. Cl.[4] ..... E05C 21/02

[52] U.S. Cl. ..... 292/340

[58] Field of Search ..... 292/340, 346, 341, DIG. 54, 292/DIG. 53, 1

[56] References Cited

U.S. PATENT DOCUMENTS

| | | | |
|---|---|---|---|
| 2,454,904 | 11/1948 | Wylie | 292/346 |
| 2,796,281 | 6/1957 | Philpott | 292/346 |
| 3,271,063 | 9/1966 | Garrett | 292/346 |
| 3,767,245 | 10/1973 | Keefe | 292/340 |
| 3,815,945 | 6/1974 | Lamphere | 292/340 |
| 3,998,483 | 12/1976 | Yan | 292/346 X |
| 4,065,162 | 12/1977 | Schlage | 292/340 |
| 4,174,862 | 11/1979 | Shane | 292/346 |
| 4,178,027 | 12/1979 | Charron | 292/346 |
| 4,415,191 | 11/1983 | Thorp | 292/346 |
| 4,416,087 | 11/1983 | Ghatak | 292/346 |

*Primary Examiner*—Richard E. Moore

*Attorney, Agent, or Firm*—Harry R. Dumont

[57] ABSTRACT

A jamb plate used to anchor the door locking bolt member in a door lock set. The plate is securely mounted intermediate a stud and the door jamb portion itself with a reinforced striker edge provided. The fastening system for the plate operator operates to distribute applied breaking or opening stresses over a large area of the plate.

6 Claims, 4 Drawing Figures

FIG. 1
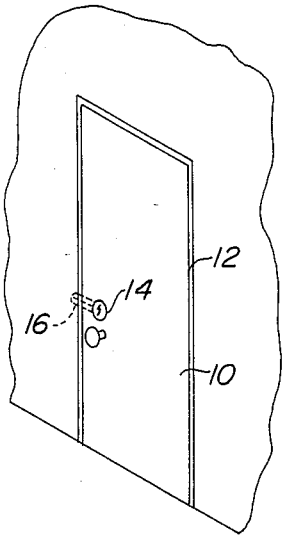
FIG. 2
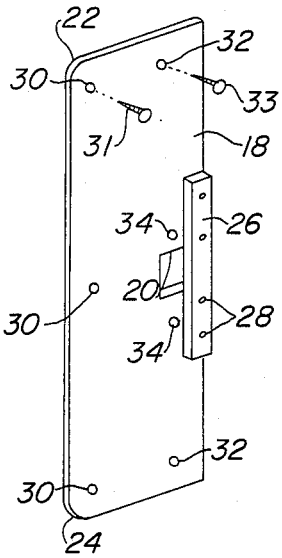
FIG. 3
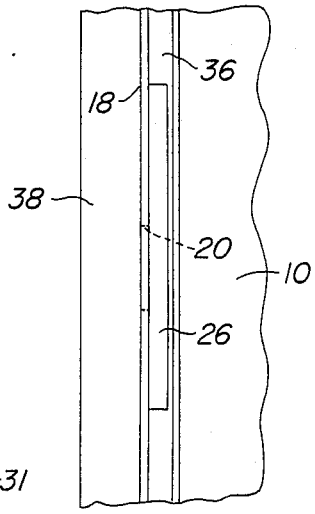
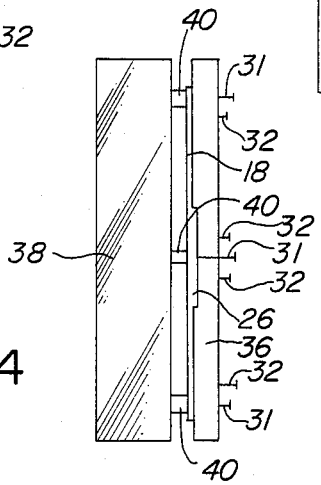
FIG. 4

DOOR LOCK JAMB PLATE AND ASSEMBLY

REFERENCE TO RELATED APPLICATION

This application is a continuation-in-part of my U.S. application Ser. No. 264,274 filed on May 18, 1981 for "DOOR LATCH PLATE", now abandoned.

BACKGROUND OF THE INVENTION

The present invention relates to an improved jamb plate and assembly for receiving either a dead bolt or a spring loaded latch which form part of the lock mechanism mounted on the door. A number of these bolt structures are well known to the prior art.

A problem exists with respect to jamb plates in that they generally are mounted on the wooden face of the jamb. The principal resistance offered to door opening forces is through a metal plate and or one or more raised wooden ribs or moldings which form a part of the door jamb structure. The present invention is adapted to solve this problem and to strengthen by its installation the entire locking arrangement and structure for the door.

Prior arrangements are known in which relatively short and narrow metal plates are mounted on the face of the door jamb to perform a variety of purposes such as preventing the insertion of cards, blades or other burglary devices between the door edge and the jamb. One such arrangement as this is shown in Charles Salazar, U.S. Pat. No. 4,017,106 issued on Apr. 12, 1977 for "STRIKE PLATE FOR SPRING BOLT DOOR LATCHES".

Another example of a reinforcing plate mounted on a jamb is shown in F. M. Fisher, U.S. Pat. No. 2,312,892 issued on Mar. 2, 1943 for "KEEPER FOR LOCKS AND LATHCES".

A still further arrangement for plates adapted to be mounted on door jambs is shown in U.S. Pat. No. 3,606,429 C. E. Palmer, issued on Sept. 20, 1971 for "ANTI-THEFT LOCK CONSTRUCTION".

BRIEF DESCRIPTION OF THE INVENTION

The present invention will be seen to provide an improved door jamb plate which by reason of its sizing, shape and characteristics greatly increases the resistance of the entire locking system to break-in. The plate is appropriately sized and has a fastening setup which permits it to be anchored first to the jamb adjacent the door stud and finally to the stud next to the frame or jamb in a novel and improved assembly. The invention may be installed in the door and door frame combination during construction or it may be added to an existing door frame in a retrofit system. The vertical length of the jamb plate is sufficient to spread the door opening stresses applied over a broad length and distributed over a relatively large and well proportioned metal resistance mass.

BRIEF DESCRIPTION OF THE DRAWINGS

In the drawings wherein like reference characters denote corresponding parts throughout the several views:

FIG. 1 is a front perspective view showing a door and door frame for installation of the jamb plate;

FIG. 2 is a perspective view showing the jamb plate and its associated fasteners;

FIG. 3 is a fragmentary front elevational view showing the jamb plate installed between a stud and frame and in operative position with respect to a opposed door and latch bolt; and FIG. 4 is a schematic view substantially similar to FIG. 3 showing a different installation of the invention.

DETAILED DESCRIPTION OF THE PREFERRED EMBODIMENT

Referring to FIG. 1 there is shown a hinged door 10 mounted in a door frame 12. A lock 13 and doorknob 14 are mounted in a position well known in the art. At one edge of the door 10, a bolt 16 is shown which is adapted to extend into a mating opening in the door jamb 10 when in a locked condition. The jamb plate 18 is shown in FIG. 2 with its opening 20 adapted to receive the extended bolt 16 from the door lock 13 in its locked condition. The jamb plate 18 is preferably formed of a high strength metal such as steel and at least two of the leading corners such as corners 22 and 24 are rounded off to facilitate the insertion of the plate between the stud and door jamb or frame during installation. In some cases, as shown in FIG. 4 hereinafter a sufficient spacing will exist between the stud and frame to permit ready insertion of the plate 18. In others it will be necessary to make a preliminary pass with a circular saw or other tool to clear an opening and to remove nails or other interferences to allow easy installing of the jamb plate 18. Also included in the jamb plate 18 is a reinforcing elongated edge block or rib 26 which is fixed to the plate by a plurality of spot-welds or other fastening means 28. The block 26 may be of a generally rectangular cross-section and acts as a rigid reinforcing rib and thus offers resistance to the breakout of a bolt 16 locked into opening 20.

A plurality of openings 30 are provided along the left hand margin of the plate 18. These openings are adapted to receive a like plurality of nails, screws or other like fasteners and to thus attach the plate 18 to the stud 38 which is located adjacent to the door jamb 36. A second plurality of openings 32 are provided along the other margin of the plate 18 to permit attachment of the door jamb plate 18 to its opposite surface. A pair of vertically spaced latch holes 34 are also included at either side of the opening 20.

FIG. 3 is an edgewise view showing the manner in which the block 26 reinforces the door jamb and provides a strong blocking force against those forces which may be applied to push door 10 open. At the left side of the door jamb 36, there is shown the stud 38. The flat part of the plate 18 is shown in its position between the stud and frame members as they are attached to the respective parts by fasteners 30 and fasteners 32. Fasteners 31 in one embodiment of my invention may be relatively large tie nails of the order of 16 penny magnitude. Threaded fasteners or smaller nails 33 may be used for attaching the frame 36 to the plate 18.

FIG. 4 shows an installation of the plate 18 into the latch jamb assembly where a large spacing exists between the plate 18 and the adjacent stud 38. Door alignment is checked to make sure proper spacing between door and frame from top to bottom. Three small blocks 40 are cut and inserted to fill the spacing at top, center and bottom. The nails 32 are driven in to secure the stud 38, blocks 40 and plate 18 together in a rigid and solid assembly.

It will thus be seen that I have provided by my invention an improved jamb plate and assembly. My invention device serves to greatly increase the strength of the locking and door closure combination. It is further adapted either for initial build into the door frame or it may be added simply and economically by retrofit. In the retrofit operation, a portion of the molding or associated jamb structure is removed to permit anchoring the jamb plate to the stud and then replaced with the final fastening of the replaced jamb structure.

I claim:

1. A latch jamb assembly for receiving a lock bolt member from an opposed door comprising in combination:

a door jamb portion;

a stud adjacent to and spaced from said door jamb portion;

a flat plate portion mounted intermediate the opposed surfaces of said door jamb portion and said stud, said flat plate portion including a pair of rounded leading edge corners for facilitating its insertion between said stud and door jamb portion during installation;

a reinforced edge portion of said flat plate portion;

a plurality of fasteners;

a first plurality of openings formed in said flat plate portion for receiving said plurality of fasteners for connecting said jamb portion in close abutment with one surface of said flat plate portion;

a second plurality of openings formed in said flat portion for receiving a like plurality of fasteners to secure the other surface of said flat portion in close abutment with said stud; and a cutout portion located in said flat portion proximate said reinforced edge portion for receiving such lock bolt member.

2. The combination as set forth in claim 1 wherein said plurality of fasteners comprise nails.

3. The combination as set forth in claim 1 wherein said plurality of fasteners comprise threaded fastener devices.

4. The combination as set forth in claim 1 wherein said reinforced edge portion is fixed to said flat portion, by welding it thereto.

5. The combination as set forth in claim 1 wherein said flat plate portion and said reinforced edge portion is of a rigid and high strength material.

6. The combination as set forth in claim 1 in which a spacing exists between said door jamb portion and said stud and a plurality of spacer blocks are mounted therebetween.

* * * * *